US007343697B2

(12) United States Patent
Dillman

(10) Patent No.: US 7,343,697 B2
(45) Date of Patent: Mar. 18, 2008

(54) LOW PROFILE FLIGHTS FOR USE IN A DRUM

(75) Inventor: Bruce A. Dillman, Prairie du Chien, WI (US)

(73) Assignee: Dillman Equipment, Inc., Prairie du Chien, WI (US)

( * ) Notice: Subject to any disclaimer, the term of this patent is extended or adjusted under 35 U.S.C. 154(b) by 81 days.

(21) Appl. No.: 11/141,701

(22) Filed: May 31, 2005

(65) Prior Publication Data

US 2006/0265898 A1 Nov. 30, 2006

(51) Int. Cl.
*F26B 11/02* (2006.01)

(52) U.S. Cl. ..... 34/137; 34/369; 366/25; 366/137

(58) Field of Classification Search ..... 34/369, 34/108, 137, 138; 366/25, 137
See application file for complete search history.

(56) References Cited

U.S. PATENT DOCUMENTS

| | | | | |
|---|---|---|---|---|
| 1,009,225 | A | 11/1911 | Cummer | |
| 2,752,130 | A | 6/1956 | French | |
| 2,815,940 | A | 12/1957 | Madsen | |
| 3,098,797 | A | 7/1963 | Graff et al. | |
| 3,296,711 | A | 1/1967 | Langford et al. | |
| 3,409,998 | A | 11/1968 | Hurst et al. | |
| 3,641,683 | A | 2/1972 | Preeman | |
| 3,717,937 | A | 2/1973 | Thompson | |
| 3,780,447 | A | 12/1973 | Fales | |
| 3,814,588 | A | 6/1974 | Eweson et al. | |
| 4,014,643 | A | 3/1977 | Musha et al. | |
| 4,136,964 | A | 1/1979 | Swisher, Jr. | |
| 4,136,966 | A | 1/1979 | Mendenhall | |
| 4,142,803 | A | 3/1979 | Mendenhall | |
| 4,147,436 | A | 4/1979 | Garbelman et al. | |
| 4,165,184 | A | 8/1979 | Schlarmann | |
| 4,189,300 | A * | 2/1980 | Butler | 432/118 |
| 4,307,520 | A | 12/1981 | Lutz | |
| 4,318,619 | A | 3/1982 | Schlarmann | |
| 4,338,732 | A | 7/1982 | Coxhill | |
| 4,391,206 | A | 7/1983 | Matteini | |
| 4,422,848 | A | 12/1983 | Musil | |
| 4,477,250 | A | 10/1984 | Brashears et al. | |
| 4,600,379 | A | 7/1986 | Elliott | |
| 4,628,614 | A | 12/1986 | Thompson | |
| 4,813,784 | A | 3/1989 | Musil | |
| 4,940,334 | A | 7/1990 | Musil | |
| 4,982,832 | A | 1/1991 | Garbelman et al. | |
| 5,033,862 | A | 7/1991 | Robison | |
| 5,067,254 | A | 11/1991 | Linkletter et al. | |
| 5,083,382 | A | 1/1992 | Brashears | |
| 5,083,870 | A | 1/1992 | Sindelar et al. | |
| 5,090,813 | A | 2/1992 | McFarland et al. | |
| 5,174,650 | A | 12/1992 | McFarland et al. | |
| 5,325,610 | A | 7/1994 | Jou | |

(Continued)

*Primary Examiner*—S. Gravini
(74) *Attorney, Agent, or Firm*—Schwartz Cooper Chartered

(57) ABSTRACT

A rotating apparatus (10) for drying a material (44) is disclosed. In one embodiment, the rotating apparatus (10) includes a generally cylindrical drum (12), a burner (20) having a burner head (22) at least partially disposed within the drum (10) and a plurality of elongated flights (26). The flights (26) are spaced-apart at pre-determined locations along an interior surface (16) of the drum (12). The length of the flights extends along the interior surface (16) of the drum (12). Optionally, a plurality of plates (28) may be utilized and positioned between the plurality of flights (26) and the interior surface (16) of the drum (12).

20 Claims, 6 Drawing Sheets

U.S. PATENT DOCUMENTS 5,350,252 A 9/1994 Musil et al.
5,380,082 A 1/1995 Milstead
5,470,146 A 11/1995 Hawkins
5,515,620 A 5/1996 Butler
5,558,432 A 9/1996 Swisher, Jr.
5,664,882 A * 9/1997 Green et al. ..... 366/25
5,772,317 A 6/1998 Butler
6,110,430 A 8/2000 Swisher, Jr. et al.
6,132,560 A 10/2000 Gerstenkorn
6,164,809 A 12/2000 Hawkins
6,185,842 B1 2/2001 Brashears
6,280,073 B1 8/2001 Dillman
6,672,751 B2 1/2004 Hawkins
6,726,351 B2 4/2004 Dillman

* cited by examiner

LOW PROFILE FLIGHTS FOR USE IN A DRUM

CROSS-REFERENCE TO RELATED APPLICATIONS

Not applicable.

FEDERALLY SPONSORED RESEARCH OR DEVELOPMENT

Not applicable.

TECHNICAL FIELD

The invention relates to one or more flights for use within a drying drum, and more particularly to low-profile flights for use within a rotating drying drum to facilitate or enhance the mixing therein.

BACKGROUND OF THE INVENTION

It is common to dry a material such as an aggregate in a rotating drum. Typically, wet material is introduced into the drum. A burner often in conjunction with a blower form a flame within the drum. The flame heats and dries the material as it moves along the interior of the drum. Dry material exits the drum at a location remote from the inlet location. However, in the past, there have been several problems associated with drying materials in such drums.

One common problem with drying materials in drums has been that material falls into the flame during the drying process. The material is initially introduced into the drum at or near the bottom of the drum. However, because the drum is rotating, the material within the drum slowly rotates up the side wall(s) of the drum. Eventually, gravity and other forces cause the material to fall in a downward direction from the side wall(s) of the drum. When the material falls in the downward direction, it occasionally passes through the flame. When material falls into the flame, it causes the undesirable effect of quenching or partially quenching the flame. Further, the hydrocarbons and other constituents within the partially combusted fuel may form smoke or other unwanted residue. In addition to environmental emissions concerns, this affects the efficiency of the drying system.

Another common problem with drying materials in drums has been that the material is not evenly dried. The material has a certain depth as it is introduced into the drum. As the drum rotates, the material is not significantly stirred. Thus, the material at or near the surface faces the flame and dries more quickly. The material at or near the surface shields the under layers of material from the heat of the flame. As a result, the under layers of material often do not dry completely.

A further problem in many existing drying drums is that the material does not advance evenly through the length of the drum. The material moves longitudinally relative to the drum as the drum rotates. When the material advances unevenly, it further worsens the problem that the material is not evenly dried. Also, the material is often very abrasive. When the material does not evenly advance, it often causes substantial wear on the drum's inner side wall surface. The drum itself is very expensive to replace.

One solution to the problem of material falling into the flame has been the use of specially designed interrupting veiling flights such as "T" flights. Interrupting veiling flights such as "T" flights are typically affixed to the inner surface of the drum. For example, interrupting veiling flights have been designed to grab material from near the bottom of the drum. The material grabbed by the interrupting veiling flights is dropped as the drum rotates. However, the material grabbed by the flights is veiled and dropped before and after it has been lifted over the hot portion of the flame. When the flight is over the hot portion of the flame, the flight works to prevent material from falling. The interrupting veiling flights also absorb the heat from the flame and shield the material being held in the flight from the flame. There are several drawbacks to using interrupting veiling flights in this manner. For example, the interrupting veiling flights often lock or hold patches of material in the spaces between the flights. The locked material is not evenly dried. The interrupting veiling flights frequently do not assist in controlling the flow or advancing the material through the length of the drum.

The present invention is provided to solve the problems discussed above and other problems, and to provide advantages and aspects not provided by prior drums of this type. A full discussion of the features and advantages of the present invention is deferred to the following detailed description, which proceeds with reference to the accompanying drawings.

SUMMARY OF THE INVENTION

The present incorporates spaced-apart elongated flights positioned along and on top of the inner surface of a drum. These flights facilitate the flow of the material longitudinally along the inner surface of the drum. The material is stirred by rolling over the elongated flights as the drum rotates and the material advances. In one embodiment, plates are utilized. The plates help to protect the inner surface of the drum from the abrasive material, as well as insulate the inner surface of the drum from heat emitted from a burner.

According to one embodiment of the present invention, a rotating apparatus for moving and drying a material is provided. The rotating apparatus includes a generally cylindrical drum, a burner, and a plurality of elongated flights strategically attached to the inner drum wall. The drum has an inlet, an outlet and an interior surface and is rotatable about its cylindrical axis. A burner has a burner head at least partially disposed within the drum for generating a flame which defines a combustion volume. The combustion volume is located between the inlet and the outlet of the drum. The elongated flights are secured to the interior surface of the drum and are spaced-apart at predetermined positions along the interior surface of the drum. Further, the length of the elongated flights extend along the interior surface of the drum.

According to another embodiment of the present invention, the rotating apparatus includes a generally cylindrical drum, a burner, a plurality of flights and a plurality of plates. The plurality of plates is fixedly secured to the entire circumference of the interior surface of the drum. The plates are cooperatively dimensioned with the interior surface of the drum with a space between the plurality of plates and the interior surface of the drum.

According to yet another embodiment of the present invention, a flight assembly for use with a drum is provided. The flight assembly includes a plate, a flight which is disposed on the plate, and a fastener. The plate is curved and has a body, a first tab and a second tab. The first tab is raised relative to the body and the second tab. The flight is curved and has a first and a second end. The curvature of the flight is configured to be substantially the same as the curvature of the plate. One or more fasteners connect the flight to the plate.

According to still another embodiment, a method is provided for drying aggregate material in a generally cylindrical drum in connection with the use of a series of elongated flights spaced-apart at predetermined positions on an interior surface of the drum. The height of the elongated flights are less than the depth of the aggregate material. The drum, which has a combustion flame within, is rotated. The method also includes introducing the aggregate material into an inlet of the drum. The aggregate material is advanced from the inlet of the drum to an outlet of the drum. Further, the aggregate material is rolled over the flights during rotation of the drum and advancement of the aggregate material. The rolling of the aggregate material reduces wear on the drum and exposes the aggregate material to heat from a burner located within the drum. The aggregate material is removed from the drum at the discharge of the drum.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
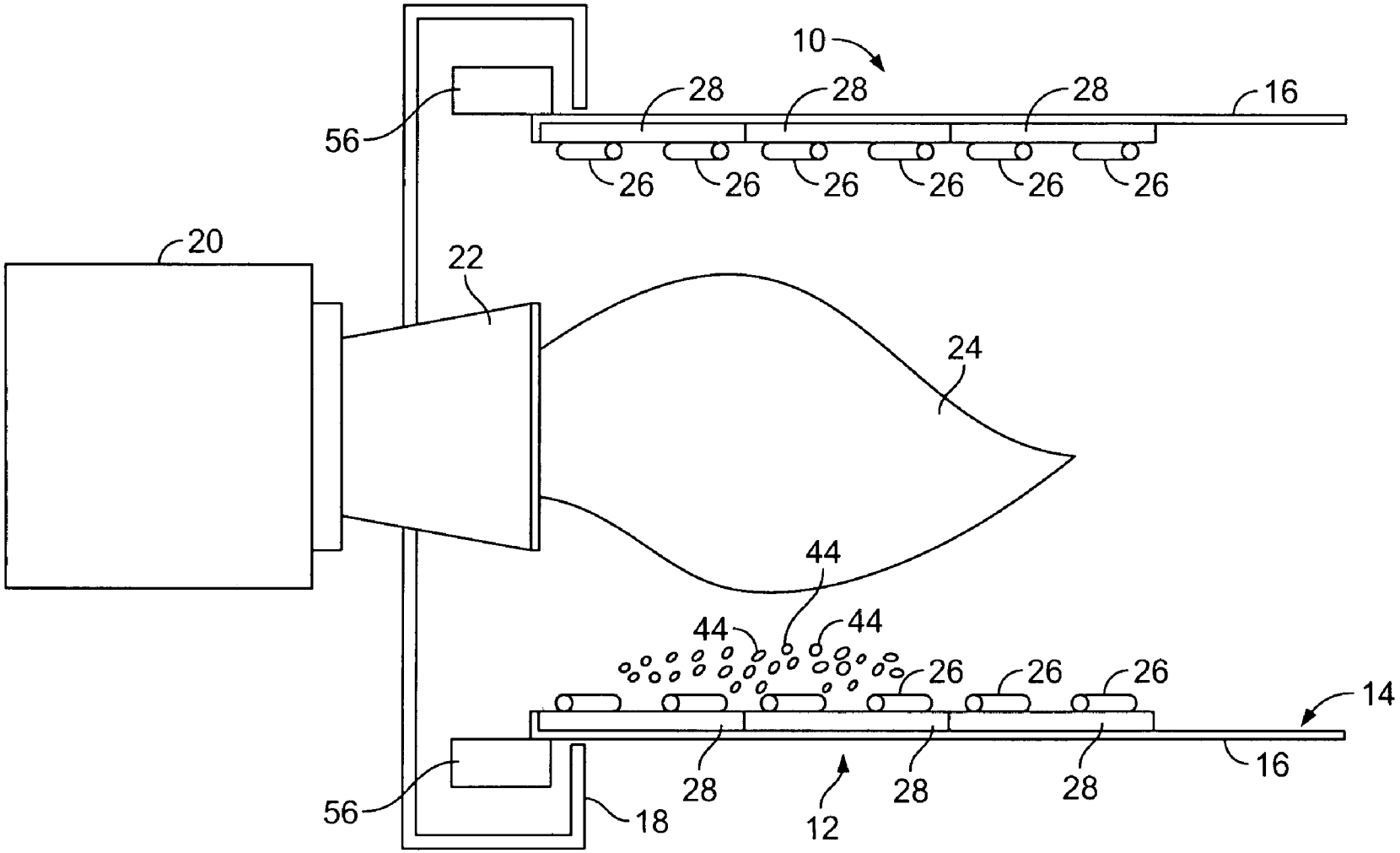
FIG. 1 is a schematic of a drum in accordance with one embodiment of the present invention.
Figure 2:
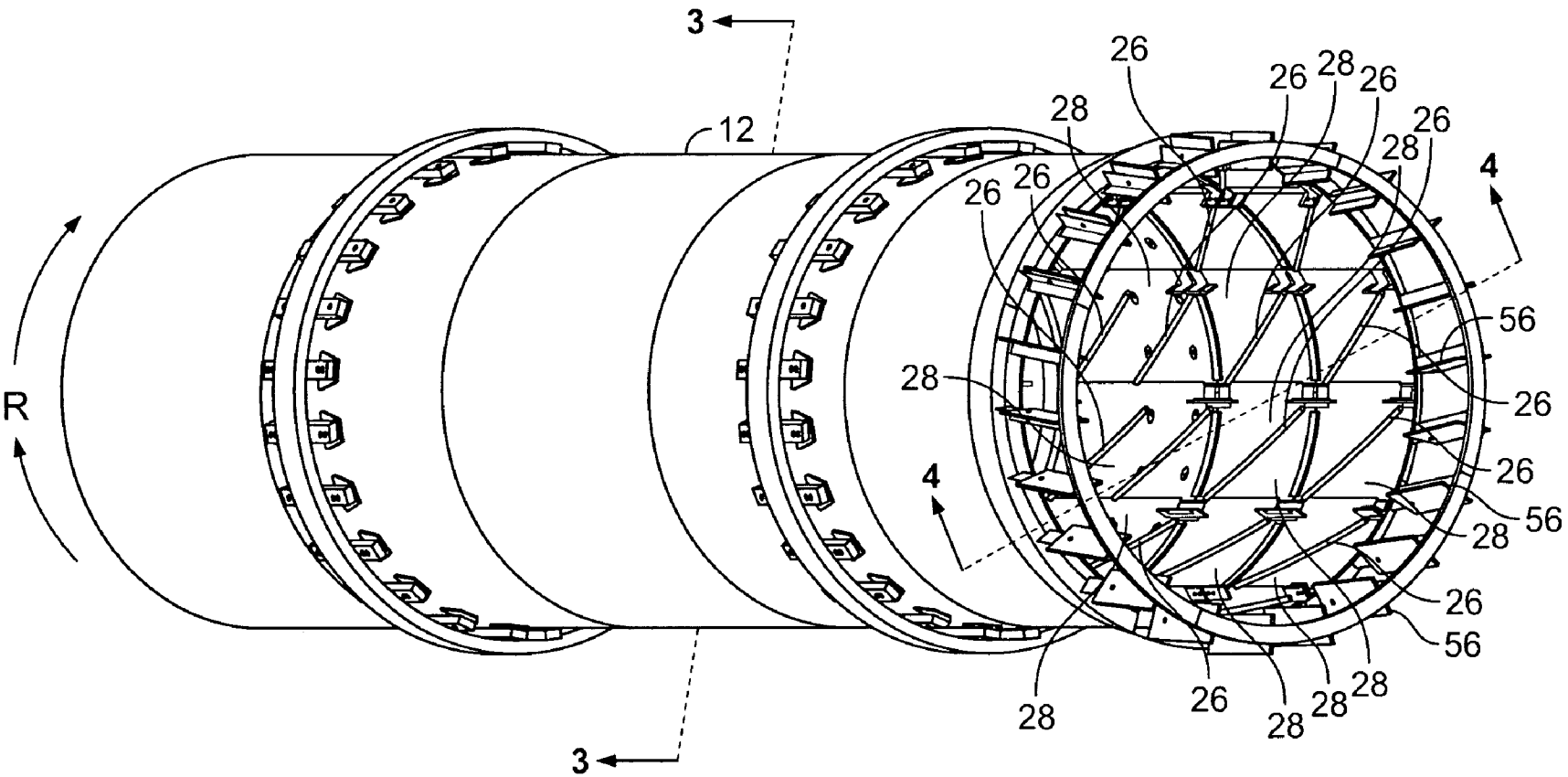
FIG. 2 is a perspective view of a drum in accordance with one embodiment of the present invention.

While this invention is susceptible of embodiments in many different forms, there is shown in the drawings and will herein be described in detail preferred embodiments of the invention with the understanding the present disclosure is to be considered as an exemplification of the principles of the invention and is not intended to limit the broad aspect of the invention to the embodiments illustrated.

Referring to FIG. 1, a rotating apparatus 10, such as a cylindrical drum, is shown for drying material 44. Material to be dried, or aggregate, is put into a drum 12 at an inlet end 14. The material 44 within the drum 12 travels longitudinally through the drum towards a burner 20 and an outlet end 18. In FIG. 1, the outer shell of the drum 12 is removed and elongated flights 26 are generally shown. The elongated flights 26 have a generally low profile and cause resistance to the material 44 as the drum 12 rotates. The elongated flights 26 help to stir the material 44 so that the material 44 more fully and evenly dries. As explained more fully below, in contrast to interrupting veiling flights such as "T" flights, the elongated flights 26 aid in preventing the material 44 from veiling. This is accomplished by the orientation and shape of the elongated flights 26 which typically maintain the material 44 close to the bottom of the drum 12. The elongated flights 26 also assist in advancing the material 44 along the length of the drum 12, and controlling the flow rate of the advancement of the material 44 along the length of the drum 12.

The rotating apparatus 10 includes the drum 12, the burner 20 and the elongated flights 26. In one embodiment of the present invention, plates 28 are positioned between the flights and the interior surface of the drum.

The drum 12 is typically cylindrical and rotates in a counterclockwise direction R. The drum has the inlet end 14, the outlet 18 and an interior surface 16. The drum is rotatable about its cylindrical axis, and rotates during the drying operation. The drum may have a radius of approximately 10 feet, 6 inches. The drum is expensive, and care is taken to prevent damage and wear to the interior surface of the drum. The outlet end 18 may be a discharge door or other outlet and typically utilizes sweeper flights 56 to move material to an outlet chute (not shown). The outlet chute may connect the drum 12 to another drum for further processing of the material 44.

The burner 20 is disposed near or partially within the drum 12. The burner 20 has a burner head 22 which may be fully or partially disposed within the drum 12 or adjacent to the drum 12. When the burner head is lit, it generates a flame 24 completely within the drum 12. The flame 24 defines a combustion volume that is located between the inlet end 14 and the outlet end 18 of the drum 12. The combustion volume is the volume within the drum 12 that the material 44 is dried. Heat from the flame dries the material in the drum.

Turning now to FIGS. 2, 3, 4 and 5, a plurality of elongated flights 26 are positioned on and along the interior surface 16 of the drum 12, preferably within the combustion volume. The elongated flights 26 are secured to the interior surface 16 of the drum 12. The elongated flights 26 may be directly secured to the interior surface 16 or secured through an intermediate or multiple intermediate parts, such as the plates 28 described more fully below. The flights 26 may be bolted, riveted, nailed, welded or otherwise fastened to secure the flights to the interior surface 16. The elongated flights 26 are fixed and stationary. The elongated flights 26 have a length that extends along the interior surface 16 of the drum 12. The longitudinal axis of the flights 26 extends along the interior surface 16. In one embodiment, the length of the elongated flights 26 are cooperatively dimensioned with the interior surface 16. While it will be understood by those of skill in the art that the elongated flights 26 may be straight or substantially straight, preferably the elongated flights 26 will have a curvature which is substantially the same as and matches the curvature of the interior surface 16 of drum 12. While the curvature of the elongated flight is typically generally constant, various non-constant curvature geometries and configurations may be used within the confines of the present invention.

The elongated flights may be formed from any material sufficient to resist the heat of the flame. One commonly used material is rebar. The elongated flights 28 are not designed primarily to shield the material 44 from the flame 24. When the material 44 is present in the drum 12, it typically completely covers the elongated flights 26. Preferably, the elongated flights 26 have a low profile with a height lower than the depth of the material 44. The height of the flights, in one embodiment, may be of no greater than one half or one third of the depth of the material. The elongated flights 26 may be smooth, have ribs or ridges, and are preferably knurled.

The elongated flights 26 in one embodiment have a generally circular cross-sectional profile. However, it will be understood by those of skill in the art that other cross-section profiles are possible including generally oval, rectangular and triangular.

Figure 3:
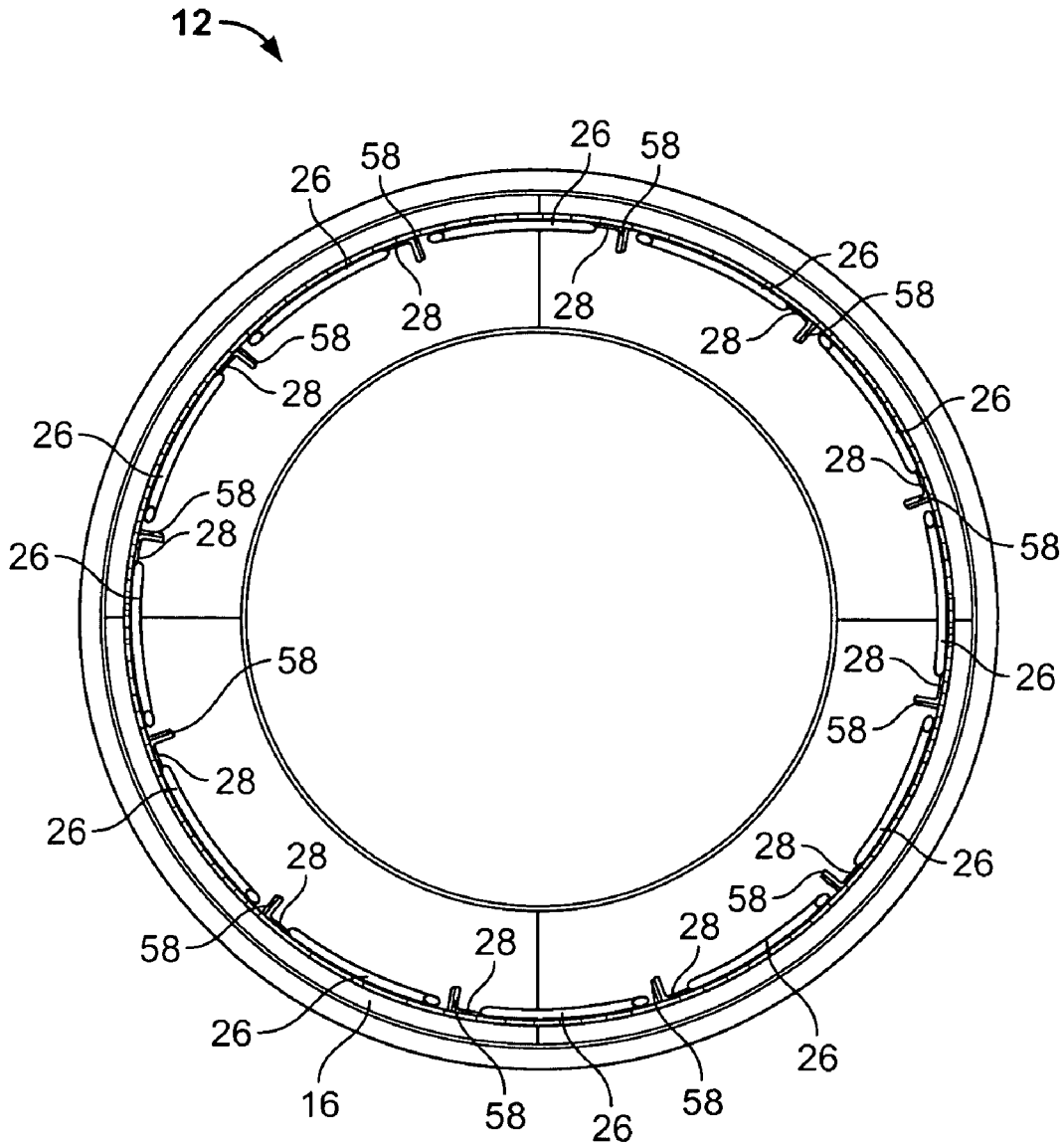
FIG. 3 is a cross-sectional view along line 3-3 of FIG. 2.
Figure 4:
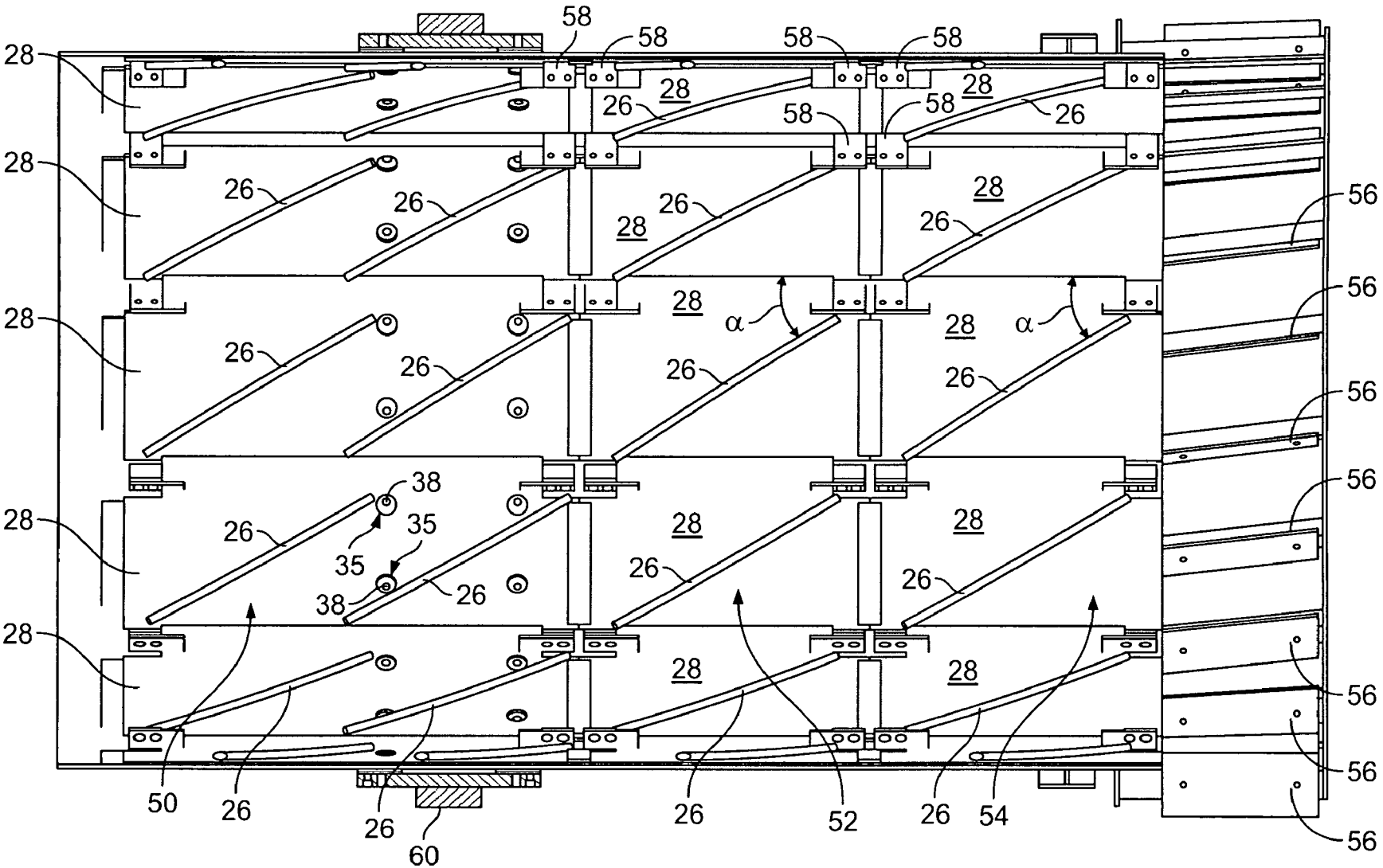
FIG. 4 is a cross-sectional view along line 4-4 of FIG. 2.

FIGS. 3 and 4 are cross sectional views of several elongated flights 26 and the interior wall or the surface 16 of the drum 12. It is contemplated that a plurality of elongated flights is utilized. The elongated flights 26 are spaced-apart at predetermined positions along the interior surface 16 of the drum 12. The elongated flights 26 are spaced-apart through the entire circumference of a particular axial position along the interior surface 16. In one embodiment, the elongated flights 26 are spaced-apart along the positions within the combustion volume of the drum 12 about one to two feet apart. At least some of the plurality of the elongated flights may be parallel. Alternatively, the elongated flights 26 may be arranged in a spiral or generally helical spiral orientation. In an embodiment of the present invention adaptable for use in a drum having a ten foot diameter, sixteen elongated flights are spaced-apart along a radial portion of the interior surface of the drum, and three elongated flights are spaced-apart along an axial portion of the interior surface 16 of the drum 12 for a total of 48 flights. As will be appreciated by those of skill in the art, the number and spacing of the flights will depend upon the size of the drum. Further, the number of flights utilized is related to the flow rate of the material and the amount of stirring of the material required.

Referring to FIG. 4, the elongated flights 26 form an acute angle a relative to a plane perpendicular to a longitudinal axis of the inner surface 16 of the drum 12. The curvature of the drum 12 distorts FIG. 4 to appear that the different elongated flights 26 form different angles relative to the plane. The elongated flights 26 form an angle $\alpha$ preferably between 20 and 45 degrees, more preferably between 30 and 40 degrees, and most preferably approximately 32 degrees. It will be understood that not all elongated flights 26 need to have the same angle $\alpha$. Angle $\alpha$ controls the flow rate of material 44 within the drum 12, and thus aids in preventing the material 44 from moving too far off the bottom surface of the drum 12 during the drum's rotation. Preventing the material 44 from moving too far off the bottom surface of the drum 12 prevents the material 44 from falling into the flame 24. Preferably, angle $\alpha$ will prevent the material 44 from moving more than 60 degrees along the radius of the interior surface 16 or approximately the eight o'clock position from the bottom of the drum 12.

Figure 6:
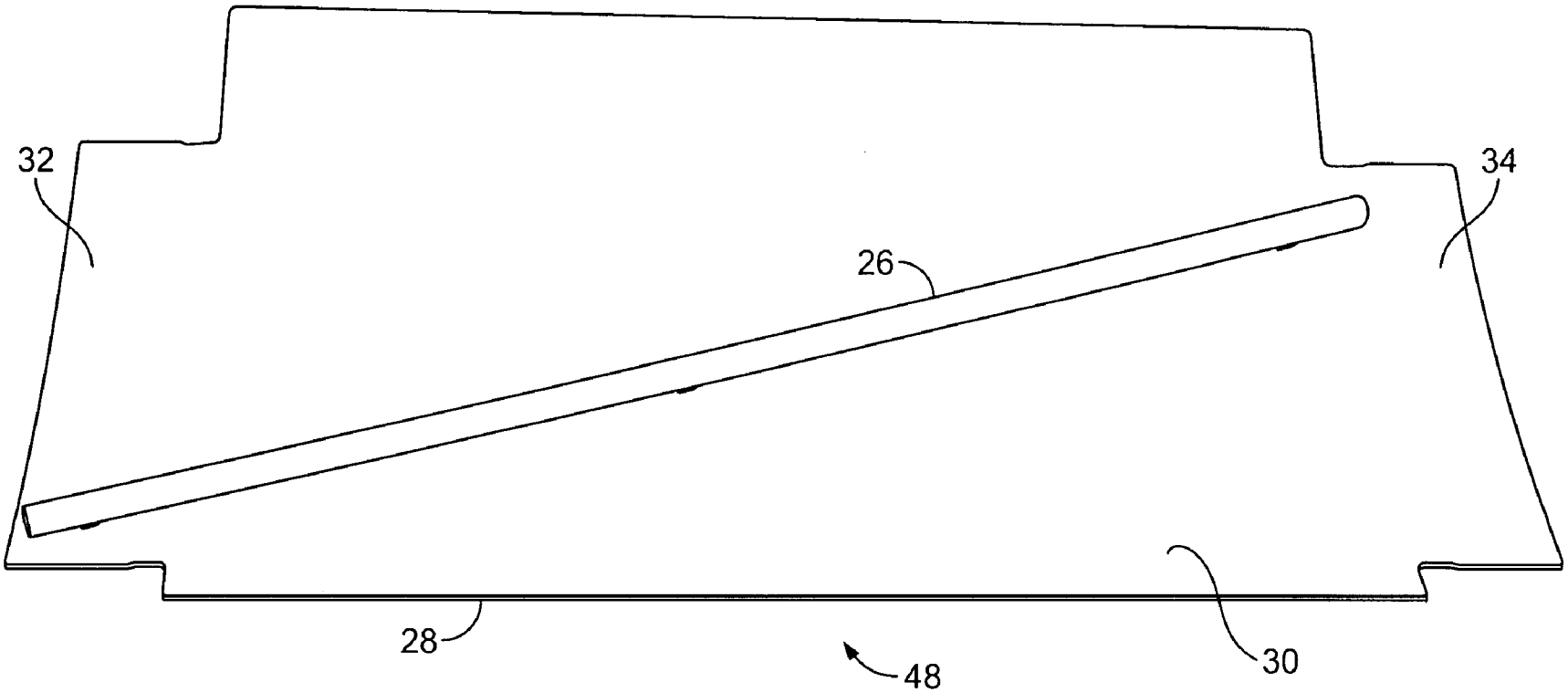
FIG. 6 is a perspective view of a flight assembly in accordance with one embodiment of the present invention; and, FIG. 7 is a top view of another embodiment of the flight assembly of the present invention.
Figure 7:
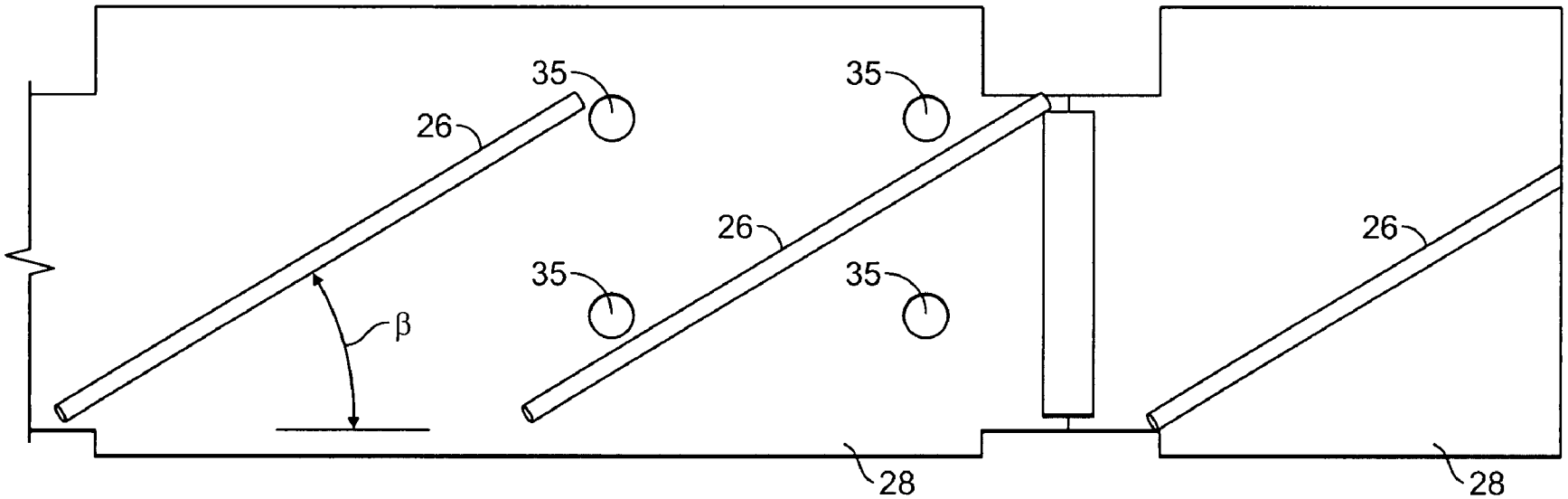

In some embodiments, a plurality of plates or removable liners 28 may be utilized. The plates 28 are made of any suitably abrasion resistant material, and are typically fabricated from steel. During the use of drying drum, the plates 28 will expand faster than the drum 12. The plates 28 have a curvature that is configured to generally correspond to the curvature of the interior surface 16 of the drum 12. The plates 28 are generally spaced-apart along the interior surface of the drum 12 in a symmetrical pattern, and may be spaced-apart along the entire circumference of the drum 12 at the same axial positions which the elongated flights 26 are present. In one embodiment, the plates 28 are present along the entire interior surface 16 of the drum 12 within the combustion volume. The elongated flights 26 may be secured to the plates 28. FIG. 6 illustrates one flight being secured to one plate. As shown in FIG. 7, alternatively two or more flights may be secured to the same plate.

Referring again to FIG. 4, the plates can be configured in several sections 50, 52 and 54. The sections may be of the same size or different. As illustrated in FIG. 4, the section 50 is wider than sections 52 and 54 (which are identical) and permits all of the bolts securing the plate to the drum to fit in one section.

As shown further in FIGS. 6 and 7, the plates 28 are secured to the interior surface 16 of the drum 12. The plates 28 have a body 30, a first tab 32 a second tab 34 and apertures 35. The body 30 may be symmetrical, or as illustrated in FIGS. 6 and 7, have a smaller protruding side and a larger protruding side. The first tab 32 is raised relative to the body 30 and the second tab 34. The first tab 32 of the plate is configured to receive a second plate with a similar construction. In one embodiment, as shown in FIG. 7, the first tab of one plate is positioned between a second plate and the interior surface of the drum. In order to fit the first tab of one plate between the second plate and the interior surface, the plate may need to be bent. The plates 28 are typically tightly placed along the interior surface 16 so that no material may fit between the plates. The plates 28 consequently may form a continuous and substantially uninterrupted skin around the inner surface 16 of the drum 12.

Brackets 58 are provided to secure the plates 28 to the drum 12. The brackets 58 are welded or otherwise affixed to the drum 12. The plates 28 fit under brackets 58. The plates 28 are bolted or otherwise secured to one bracket 58 at one end of plate 28. The other end of plate 28 slides under a second bracket 58. This relationship and orientation permits plates 28 to expand axially as the plate 28 is heated.

The rotating apparatus 10 may also include bolts 36 to connect the plates 28 to a tire support 60 or to the interior surface 16 of the drum. The bolts 36 fit within the apertures 35 to permit the plates to expand relative to the interior surface of the drum as the interior surface of the drum is heated by the burner. The bolts 36 may include a bolt head 38 and a ring or spacer 40. The ring or spacer deflects wear on the bolt head. The apertures 35 may be larger than the bolts 36 to permit some flexibility or play during heating of the plates.

Figure 5:
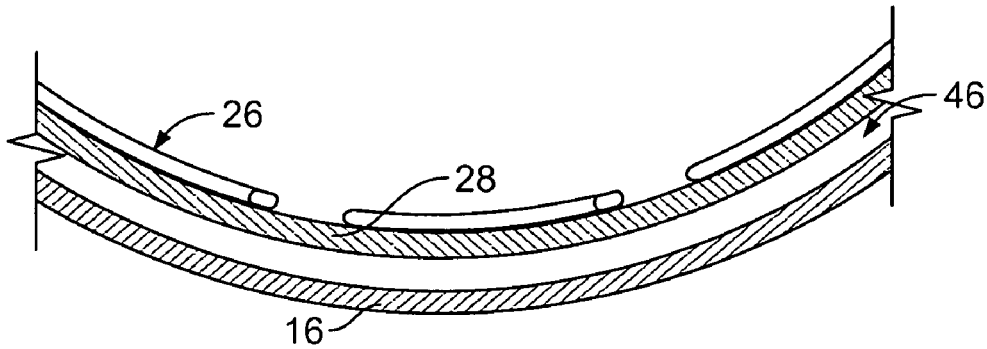
FIG. 5 is an enlarged cross-sectional view along line 5-5 of FIG. 4.

As illustrated in FIG. 5, a space 46 may be formed between the plates 28 and the interior surface 16 of the drum 12. This space is typically between ¼ and ½ of an inch, and preferably approximately ¼ inch. The space 46 helps insulate the interior surface of the drum from the heat from flame 24. Insulating the interior surface prevents damage to the drum itself.

Referring again to FIG. 6, a flight assembly 48 for use with the drum 12 is shown. The flight assembly 48 includes a plate 28, a flight 26 and a fastener (not shown). The fastener may be a screw, bolt, nail, rivet or other device suitable to fasten the flight to the plate. In one embodiment, the flight is situated at an acute angle $\beta$ which may be approximately 30 degrees.

In light of the above, drying aggregate material in a generally cylindrical drum can be readily achieved. The drying is facilitated by the use of a series of elongated flights spaced-apart at pre-determined positions on an interior surface of the drum. The height of the elongated flights is less than the depth of the aggregate material during full flow. The length, height and angle $\alpha$ of the elongated flights can be varied or altered to adjust the flow rate of the material. Further, the number and pre-determined location of the flights can be changed. All of these parameters are related to the dryness of the exiting material and the flow rate. The method also includes rotating the drum, typically in the counterclockwise direction.

The aggregate material is introduced into an inlet of the drum. The aggregate material is advanced from the inlet of the drum to an outlet or discharge door of the drum. While the drum is rotating and at least a portion of the aggregate material is advancing, the aggregate material is rolled over the elongated flights. Usually, the material covers the entire height of the elongated flights. Rolling the aggregate material stirs the material and promotes even drying of the material. It also reduces wear on the drum and exposes the aggregate material to heat from the burner located within the drum.

Finally, the aggregate material is removed from the drum at the discharge of the drum. In one embodiment, there are a plurality of plates spaced-apart on the interior surface of the drum, and at least one elongated flight is positioned on each plate. The plates shield the interior surface of the drum from the combustion flame, typically through the use of a space or gap between the plate and the interior surface of the drum.

While the specific embodiments have been illustrated and described, numerous modifications come to mind without significantly departing from the spirit of the invention, and the scope of protection is only limited by the scope of the accompanying claims.

What is claimed is:

1. A rotating apparatus for drying a material comprising:

a generally cylindrical drum having an inlet, an outlet and an interior surface having a bottom portion, the drum being rotatable about its cylindrical axis;

a burner having a burner head at least partially disposed within the drum for generating a flame defining a combustion volume and located between the inlet and the outlet of the drum; and a plurality of elongated flights secured to the interior surface of the drum, spaced-apart at predetermined positions along the interior surface of the drum within the combustion volume and having a length extending along the interior surface of the drum with a curvature substantially following that of the interior surface and having a generally solid, low, roundish profile for causing resistance to the advancing material rolling thereover while maintaining the material generally relatively close to the bottom portion.

2. The rotating apparatus of claim 1, wherein the elongated flights have a height of no greater than one half of a depth of the material.

3. The rotating apparatus of claim 1, wherein the elongated flights have a curvature generally corresponding to the curvature of the interior surface of the drum.

4. The rotating apparatus of claim 1, wherein the elongated flights form an acute angle relative to a plane perpendicular to a longitudinal axis of the inner surface of the drum.

5. The rotating apparatus of claim 1, wherein the elongated flights form an angle between 20 and 45 degrees relative to a plane perpendicular to a longitudinal axis of the inner surface of the drum.

6. The rotating apparatus of claim 1, wherein the elongated flights form an angle between 30 and 40 degrees relative to the plane perpendicular to a longitudinal axis of the inner surface of the drum.

7. The rotating apparatus of claim 1, wherein the elongated flights form an angle of approximately 32 degrees relative to the plane perpendicular to a longitudinal axis of the inner surface of the drum.

8. The rotating apparatus of claim 1, further comprising a plurality of plates fixedly secured to the elongated flights positioned between the elongated flights and the interior surface of the drum.

9. The rotating apparatus of claim 8, wherein a space is defined between the plates and the interior surfaces of the drum.

10. The rotating apparatus of claim 9, wherein the space is between approximately ¼ and ½ inch.

11. The rotating apparatus of claim 10, wherein the plurality of the plates comprises at least a first and a second plate, the first plate having a tab positioned between the second plate and the interior surface of the drum.

12. The rotating apparatus of claim 8, further comprising bolts connecting the plates to the interior surface of the drum for permitting the plates to expand relative to the interior surface of the drum as the interior surface of the drum is heated by the burner.

13. A flight assembly for use with a drying drum having an interior surface, the flight assembly comprising:

a plate having a body, a first tab, a second tab and a curvature inside and generally corresponding to the curvature of the interior surface of the drum, such that the first tab is raised relative to the body and the second tab;

a flight disposed on the plate having a first and a second end and a curvature configured to be substantially the same as the curvature of the plate; and a fastener connecting the flight to the plate and a bracket connecting the plate to the interior surface of the drum with a space between the plate and inner drum surface.

14. The flight assembly of claim 13, wherein the first tab of the plate is configured to receive a second plate.

15. The flight assembly of claim 13, further comprising a second plate having a body, a first tab, a second tab and a curvature, such that the first tab of the second plate is raised relative to the body and the second tab of the second plate, and the first tab of the first plate is received by the second tab of the second plate.

16. The flight assembly of claim 13, wherein the flight has a generally circular cross sectional profile.

17. The flight assembly of claim 13, wherein the plate has a curvature generally corresponding to the curvature of the interior surface of the drum.

18. A rotating apparatus for drying a material comprising:

a generally cylindrical drum having an inlet, an outlet and an interior surface, the drum being rotatable about its cylindrical axis;

a burner having a burner head at least partially disposed within the drum for generating a flame defining a combustion volume and located between the inlet and the outlet of the drum;

a plurality of plates in a continuous and substantially uninterrupted pattern fixedly secured to the entire circumference of the interior surface of the drum and is cooperatively dimensioned with the interior surface of the drum forming a protective sleeve over the interior surface of the drum;

a space being defined between the plurality of plates and the interior surface of the drum; and a plurality of elongated flights secured to the plates, cooperatively dimensioned with the plates, spaced-apart at predetermined positions along the interior surface of the drum within the combustion volume and having a length extending along the interior surface of the drum with a solid core.

19. A method of drying aggregate material in a generally cylindrical drum in connection with the use of a series of elongated flights spaced-apart at predetermined positions on an interior surface of the drum having a height less than the depth of the aggregate material, the method comprising the steps of:

rotating the drum with a combustion flame therein;

introducing the aggregate material into an inlet of the drum;

advancing the aggregate material longitudinally from the inlet to an outlet with the elongated flights having a curvature substantially following that of the interior surface and having a generally solid, low, roundish profile for causing resistance to the advancing aggregate material rolling thereover and the elongated flights forming a predetermined acute angle relative to the plane perpendicular to a longitudinal axis of the inner surface of the drum for advancing the aggregate material through the drum at a predetermined rate;

rolling the aggregate material over the elongated flights during the step of rotating the drum and at least a portion of the step of advancing the aggregate material, the rolling the aggregate material step reducing wear on the drum and exposing the aggregate material to heat from a burner located within the drum without dropping the aggregate material through the combustion flame; and removing the aggregate material from the drum at the outlet.

20. The method according to the claim 19, further comprising the step of providing a plurality of plates spaced-apart on the interior surface of the drum, at least one flight is positioned on each plate, and further comprising the step of shielding at least a portion of the interior surface of the drum from the combustion flame by a plurality of plates forming a sleeve between the interior surface of the drum and the flame.

* * * * *